US009048555B2

(12) United States Patent
Chou

(10) Patent No.: US 9,048,555 B2
(45) Date of Patent: Jun. 2, 2015

(54) WIRE CONNECTOR

(71) Applicant: Ming-Yi Chou, Kaohsiung (TW)

(72) Inventor: Ming-Yi Chou, Kaohsiung (TW)

( * ) Notice: Subject to any disclaimer, the term of this patent is extended or adjusted under 35 U.S.C. 154(b) by 0 days.

(21) Appl. No.: 14/203,805

(22) Filed: Mar. 11, 2014

(65) Prior Publication Data

US 2015/0072571 A1 Mar. 12, 2015

Related U.S. Application Data

(63) Continuation-in-part of application No. 14/024,973, filed on Sep. 12, 2013, now abandoned.

(51) Int. Cl.
*H01R 11/09* (2006.01)
*H01R 13/04* (2006.01)

(52) U.S. Cl.
CPC ..... *H01R 13/04* (2013.01)

(58) Field of Classification Search
USPC ..... 439/796, 877, 851, 441, 855, 166
See application file for complete search history.

(56) References Cited

U.S. PATENT DOCUMENTS 3,397,380 A * 8/1968 Puig ..... 439/417
3,736,548 A * 5/1973 Double ..... 439/166
3,891,297 A * 6/1975 Poliak et al. ..... 439/657
4,176,898 A * 12/1979 Marechal ..... 439/139
5,580,284 A * 12/1996 Laricchia ..... 439/783
6,129,576 A * 10/2000 Sakaguchi et al. ..... 439/465
6,293,832 B1 * 9/2001 Yamamoto ..... 439/850
6,548,761 B1 * 4/2003 Wang ..... 174/74 R
6,923,677 B2 * 8/2005 Hsu ..... 439/531
7,175,469 B1 * 2/2007 Daily et al. ..... 439/441
7,540,753 B2 * 6/2009 Dobler ..... 439/346
7,727,002 B2 * 6/2010 Bethurum et al. ..... 439/441
7,789,718 B2 * 9/2010 Desard et al. ..... 439/796
7,803,007 B1 * 9/2010 Chou ..... 439/441
8,348,705 B2 * 1/2013 Dickenson ..... 439/784
8,821,184 B2 * 9/2014 Yu et al. ..... 439/512

* cited by examiner

*Primary Examiner* — Alexander Gilman

(57) ABSTRACT

A wire connector includes a connection box having two closed end walls spaced in a longitudinal direction. The connect box includes a compartment having first and second end walls spaced in a height direction. At least one partitioning wall extends from the second end wall toward but spaced from the first end wall, defining a gap. The at least one partitioning wall divides the compartment into a plurality of channels spaced in a width direction. The channels are respectively aligned with and in communication with through-holes in at least one of the closed end walls. Each channel has a first end at the first end wall and a second end at the second end wall. The first ends of the channels and the gap together define a flat receiving groove in which a conductive plate is received. An elastic pressing plate is received in each channel.

10 Claims, 8 Drawing Sheets

WIRE CONNECTOR

CROSS REFERENCE TO RELATED APPLICATION

This is a continuation-in-part application of U.S. patent application Ser. No. 14/024,973 filed Sep. 12, 2013, currently pending.

BACKGROUND OF THE INVENTION

The present invention relates to a wire connector and, more particularly, to a wire connector providing electrical connection for electric wires.

Conventionally, electric wires having insufficient lengths are interconnected by intertwining two ends respectively of two electric wires and then wrapping the intertwined ends with an insulating tape, which is troublesome and has risks resulting from disengagement of the insulating tape.

Although cable connection terminals have been proposed to solve the drawbacks of interconnection by an insulating tape, these cable connection terminals still have disadvantages including poor conductivity and high temperatures resulting from very limited contact areas between the electric wire and an elastic pressing member and between the electric wire and a common conductive plate, and the cable holes are only formed in an end of the cable connection terminal. To overcome the disadvantages of the conventional cable connection terminals, U.S. Pat. No. 7,803,007 discloses a connecting terminal for a cable including a conductive column in a terminal box. A plurality of steel elastic sheets is provided around the conductive column. The conductive column includes a plurality of arc slots corresponding to the steel elastic sheets. A conductive end of a cable is inserted into a cable hole into the terminal box, is pressed by a pressing portion of one of the steel elastic sheet, and tightly contacts one of the arc slots, improving the conductivity by increasing the contact area. The use safety is, thus, improved. However, the shape and location of the conductive column surrounded by the steel elastic sheets is limited and, thus, restricts the shape of the terminal box. Use of the connecting terminal is also limited by the specific structure.

Thus, a need exists for a novel wire connector without undesired limitations to the shape and location.

BRIEF SUMMARY OF THE INVENTION

A wire connector according to an aspect of the present invention includes a connection box having first and second ends spaced from each other in a longitudinal direction. The first end of the connection box includes a first closed end wall having a first hole set. The second end of the connection box includes a second closed end wall having a second hole set. Each of the first and second hole sets includes at least one through-hole. The connection box further includes a compartment having first and second end walls spaced from each other in a height direction perpendicular to the longitudinal direction. At least one partitioning wall extends from the second end wall toward but spaced from the first end wall, defining a gap between the at least one partitioning wall and the first end wall. The at least one partitioning wall divides the compartment into a plurality of channels spaced from each other in a width direction perpendicular to the longitudinal and height directions. The plurality of channels is respectively aligned with and in communication with the at least one through-hole of the first hole set and the at least one through-hole of the second hole set. Each of the plurality of channels has a first end at the first end wall and a second end at the second end wall. The first ends of the plurality of channels and the gap together define a receiving groove. The receiving groove is flat. An elastic pressing plate is received in each of the plurality of channels. A conductive plate is received in the receiving groove and has a shape corresponding to a shape of the receiving groove. The conductive plate abuts each elastic pressing plate.

The wire connector according to the present invention has a reduced height in the height direction by providing the flat receiving groove and the flat conductive plate, allowing the wire connector to be used in a small space.

In another aspect, a wire connector includes a connection box having first and second ends spaced from each other in a longitudinal direction. The first end of the connection box includes a first closed end wall. The second end of the connection box includes a second closed end wall having a hole set. The hole set includes at least one through-hole. The connection box further includes a compartment having first and second end walls spaced from each other in a height direction perpendicular to the longitudinal direction. The at least one partitioning wall extends from the second end wall toward but spaced from the first end wall, defining a gap between the at least one partitioning wall and the first end wall. The at least one partitioning wall divides the compartment into a plurality of channels spaced from each other in a width direction perpendicular to the longitudinal and height directions. The plurality of channels is respectively aligned with and in communication with the at least one through-hole of the hole set. Each of the plurality of channels has a first end at the first end wall and a second end at the second end wall. The first ends of the plurality of channels and the gap together define a receiving groove. The receiving groove is flat. An elastic pressing plate is received in each of the plurality of channels. A conductive plate is received in the receiving groove and has a shape corresponding to a shape of the receiving groove. The conductive plate abuts each elastic pressing plate.

In an example, at least one of the elastic pressing plates is vortical and includes an inner section and an outer section. The inner section includes a bent arm. The bent arm abuts against the outer section and is adapted to provide a resistance to a force imparted to the outer section pressing against the bent arm. Preferably, the bent arm is formed by bending a distal end of the inner section of the elastic pressing plate.

In another example, each elastic pressing plate is vortical, and the outer section of each elastic pressing plate has a hook. Preferably, the hook is formed at a distal end of the outer section.

The present invention will become clearer in light of the following detailed description of illustrative embodiments of this invention described in connection with the drawings.

DETAILED DESCRIPTION OF THE INVENTION

Figure 1:
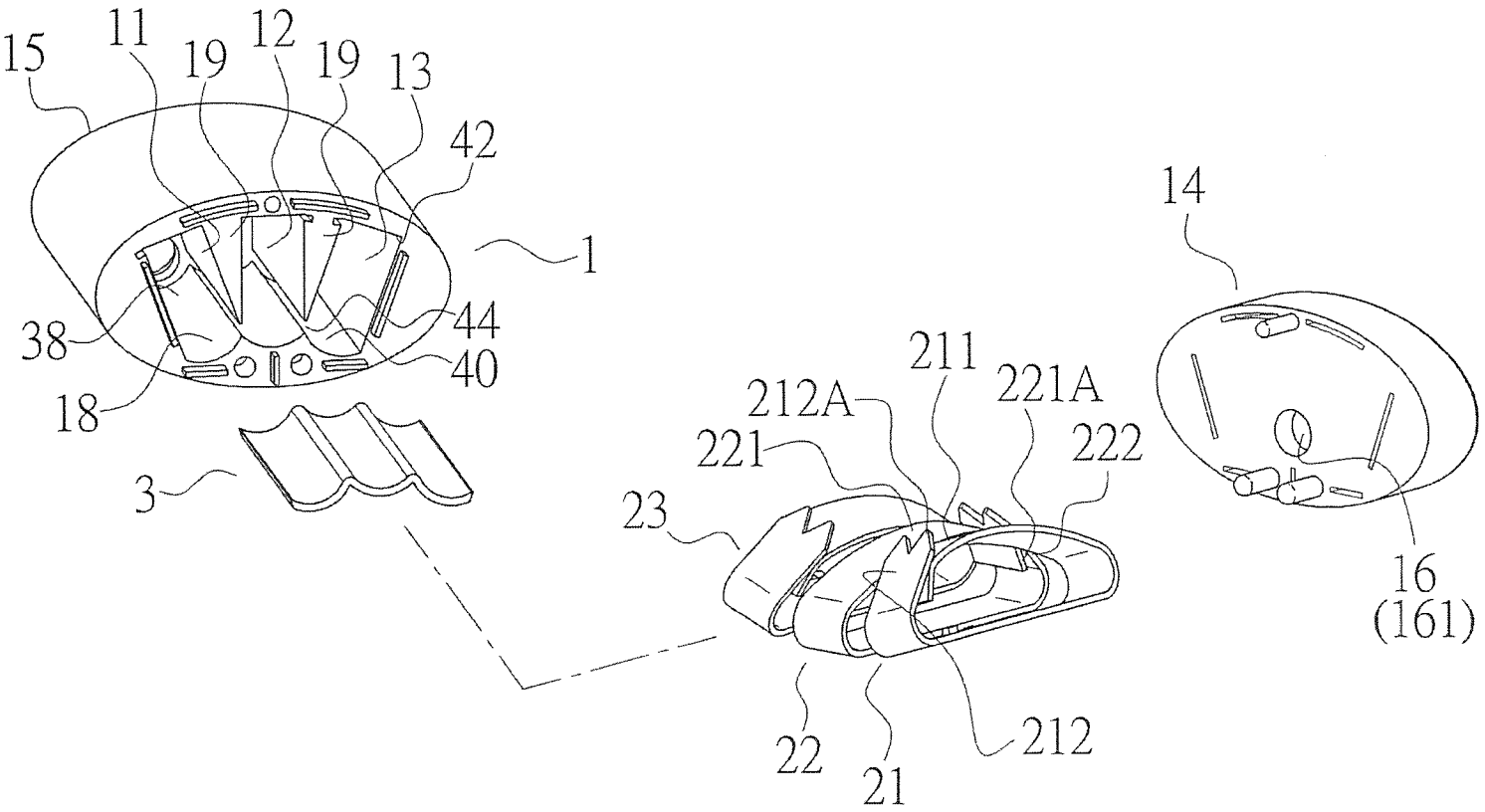
FIG. 1 is an exploded, perspective view of a wire connector of a first embodiment according to the present invention.
Figure 3:
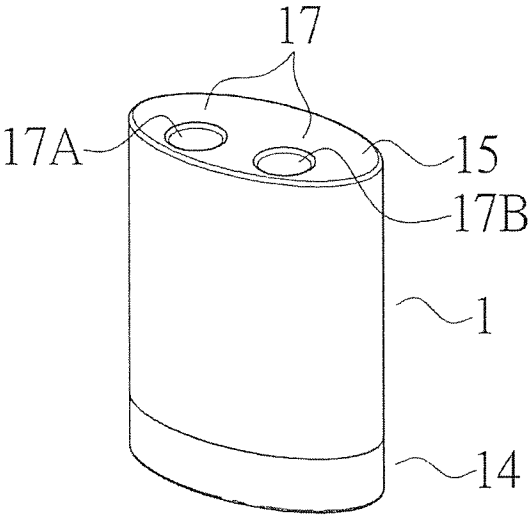
FIG. 3 is another perspective view of the wire connector of FIG. 1.
Figure 2:
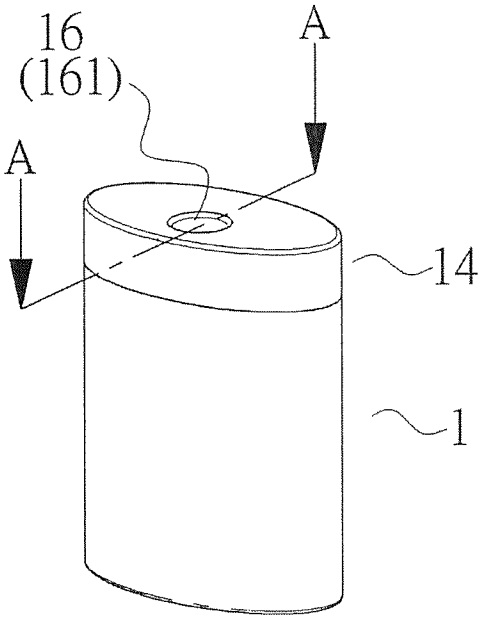
FIG. 2 is perspective view of the wire connector of FIG. 1.

With reference to FIGS. 1-3 and 6, a wire connector of a first embodiment according to the present invention includes a connection box 1 having first and second ends spaced from each other in a longitudinal direction. The first end of the connection box 1 includes a first closed end wall 14 having a first hole set 16. In this embodiment, the first end wall 14 is in the form of a cover detachably mounted to the first end of the connection box 1. The second end of the connection box 1 includes a second closed end wall 15 having a second hole set 17. Each of the first and second hole sets 16 and 17 includes at least one through-hole. In this embodiment, the first hole set 16 includes a through-hole 161, and the second hole set 17 includes two through-holes 17A and 17B.

The connection box 1 further includes a compartment 38 having first and second end walls 40 and 42 spaced from each other in a height direction perpendicular to the longitudinal direction. At least one partitioning wall 19 extends from the second end wall 42 toward but spaced from the first end wall 40, forming a gap 44 between each partitioning wall 19 and the first end wall 40. The at least one partitioning wall 19 divides the compartment 38 into a plurality of channels 11, 12, 13 spaced from each other in a width direction perpendicular to the longitudinal and height directions. In this embodiment, the connection box 1 includes two partitioning walls 19 and three channels 11, 12, and 13. The channels 11, 12, and 13 are respectively aligned with and are in communication with the through-holes 161, 17A, and 17B of the first and second hole sets 16 and 17. Each channel 11, 12, 13 has a first end at the first end wall 40 and a second end at the second end wall 42. The first ends of the channels 11, 12, and 13 and the gaps 44 together define a receiving groove 18. The receiving groove 18 is flat.

The wire connector of the first embodiment further includes an elastic pressing plate 21, 22, 23 received in each channel 11, 12, 13. A conductive plate 3 is received in the receiving groove 18 and has a shape corresponding to a shape of the receiving groove 18. The conductive plate 3 abuts each elastic pressing plate 21, 22, 23. The wire connector according to the present invention has a reduced height in the height direction by providing the flat receiving groove 18 and the flat conductive plate 3, allowing the wire connector to be used in a small space.

Figure 4A:
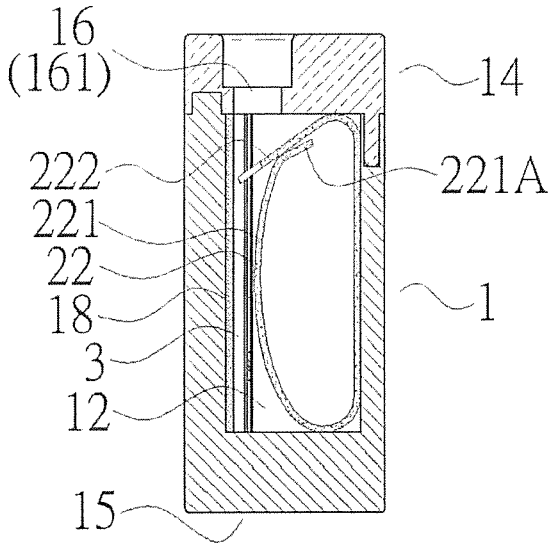
FIG. 4A a cross sectional view taken along section line A-A of FIG. 2.
Figure 4B:
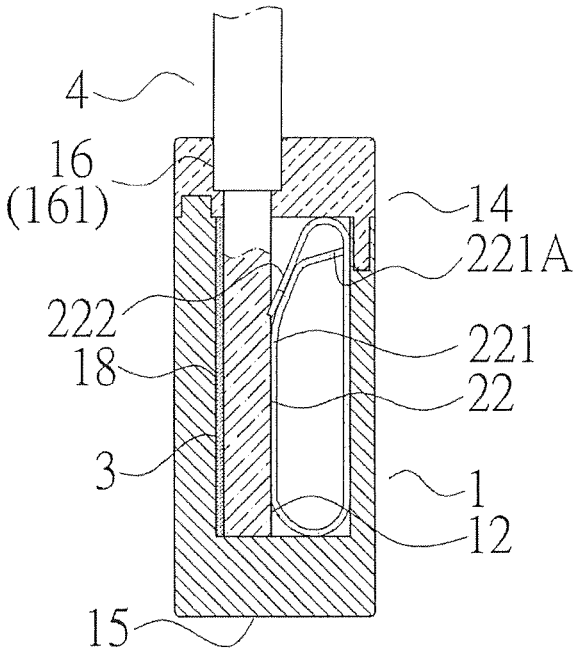
FIG. 4B is a view similar to FIG. 4A, with an end of an electric wire inserted into the wire connector and retained in place by an elastic retaining plate of the wire connector of FIG. 1.

With reference to FIGS. 1, 4A, and 4B, at least one of the elastic pressing plates 21, 22, and 23 is vortical. Taking elastic pressing plate 22 as an example, the elastic pressing plate 22 includes an inner section 221 and an outer section 222 integral with the inner section 221. The inner section 221 includes a bent arm 221A abutting against the outer section 222 to provide a resistance to a force imparted to the outer section 222 pressing against the bent arm 221A when an end of an electric wire 4 is inserted into a corresponding one of the channels 11, 12 and 13. The inner section 221 of the elastic pressing plate 22 elastically presses against the end of the electric wire 4 to firmly retain the end of the electric wire 4 in place, assuring reliable electrical conduction. In this example, the bent arm 221A is formed by bending a distal end of the inner section 221 of the elastic pressing plate 22 (see FIG. 4A).

Figure 5:
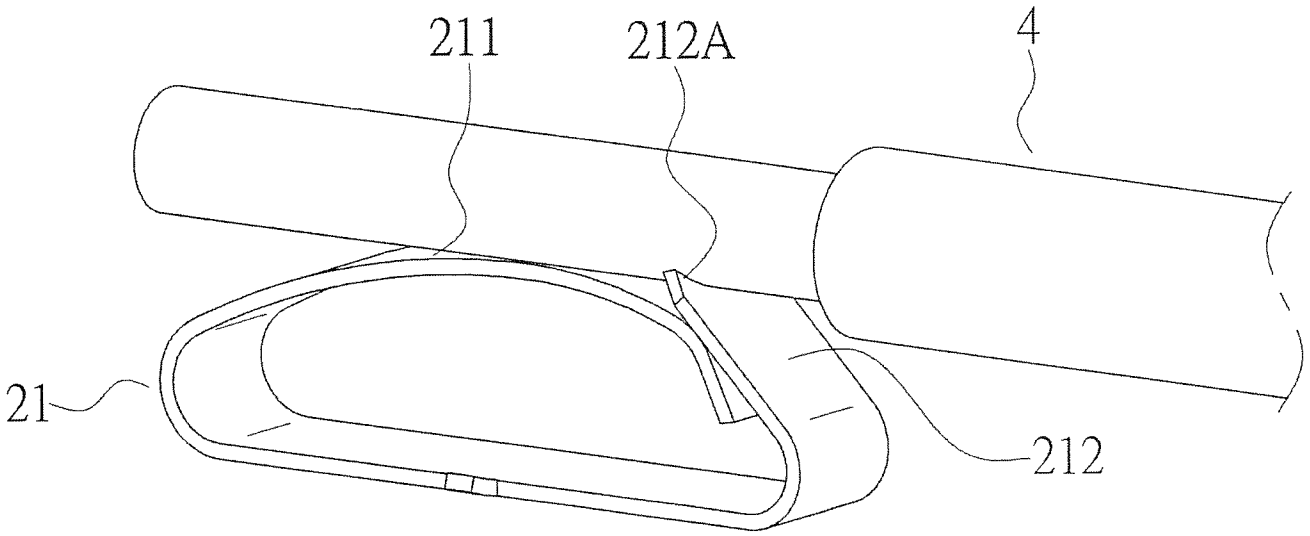
FIG. 5 is a perspective view illustrating coupling of the end of the electric wire and a hook of an elastic retaining plate of the wire connector of FIG. 1.
Figure 6:
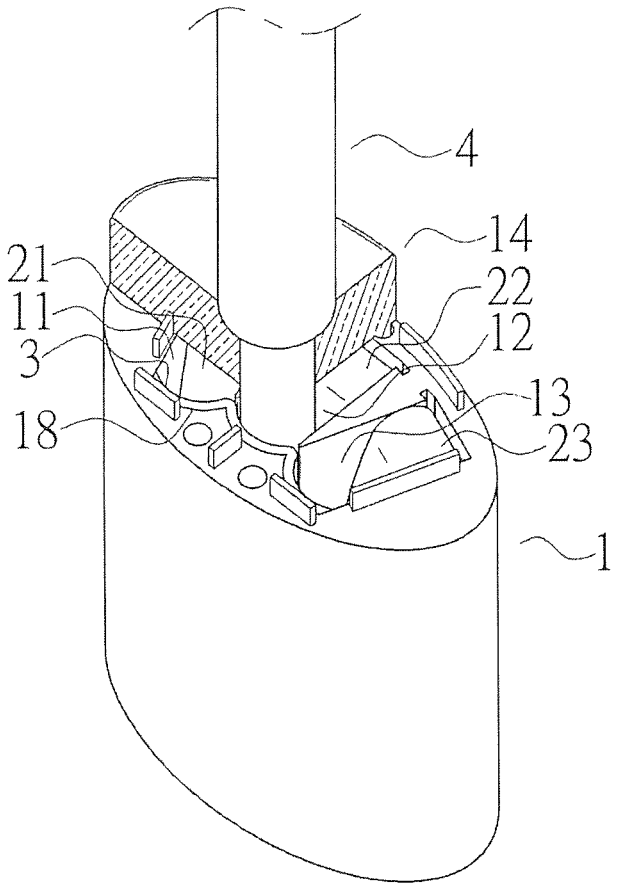
FIG. 6 is a partial, perspective of the wire connector of FIG. 1, with the end of the electric wire inserted into the wire connector.

In another example, with reference to FIG. 5, the elastic pressing plate 21 is vortical and includes an outer section 212 and an inner section 211 integral with the outer section 212. The outer section 212 of the elastic pressing plate 21 has a hook 212A. The hook 212A includes a V-shaped groove for receiving a portion of the end of the electric wire 4. Thus, when the end of the electric wire 4 enters one of the channels 11, 12, and 13, the hook 212A can provide a hooking effect to prevent disengagement of the electric wire 4 under a pulling force. To allow easy fabrication, the hook 212A is preferably formed at a distal end of the outer section 212. The other elastic pressing plates 22 and 23 can also include a hook 212A.

Figure 7:
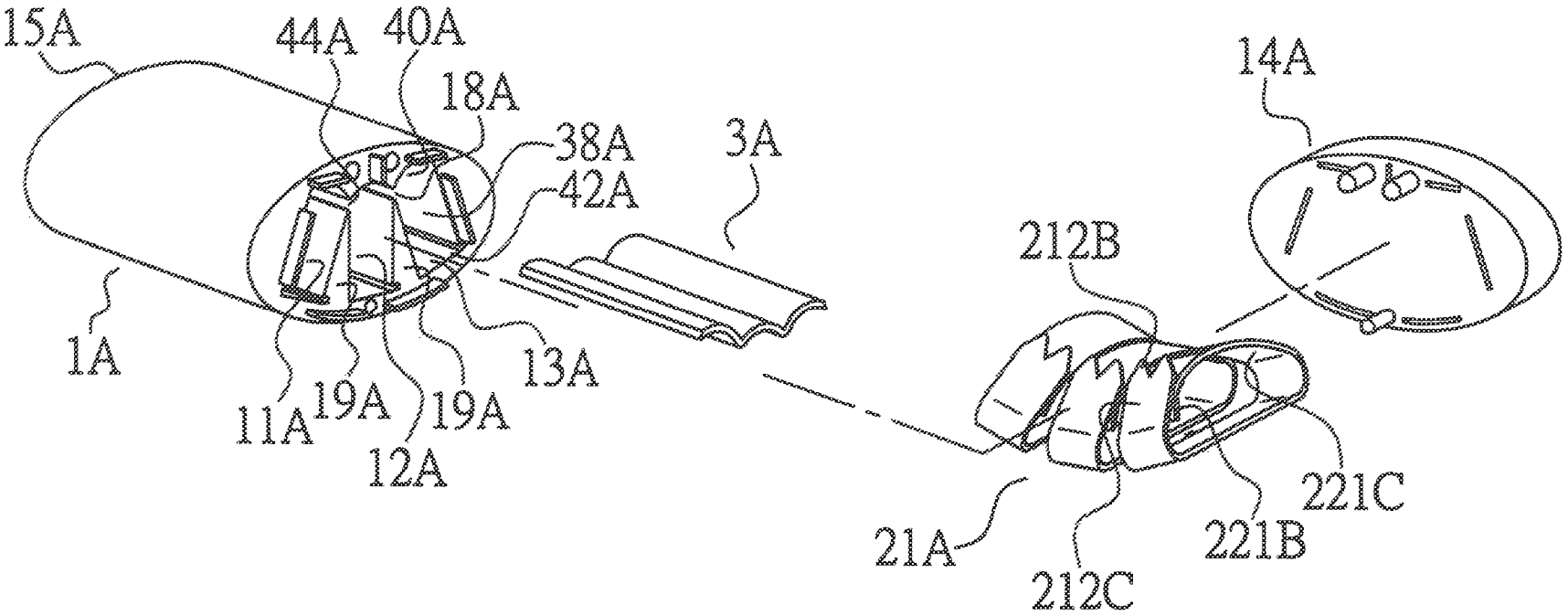
FIG. 7 is an exploded, perspective view of a wire connector of a second embodiment according to the present invention.
Figure 9:
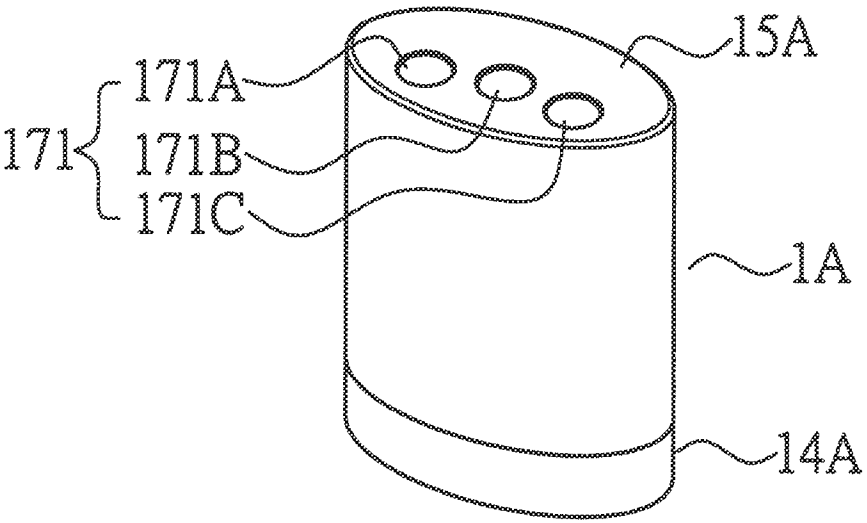
FIG. 9 is another perspective view of the wire connector of FIG. 7.
Figure 8:
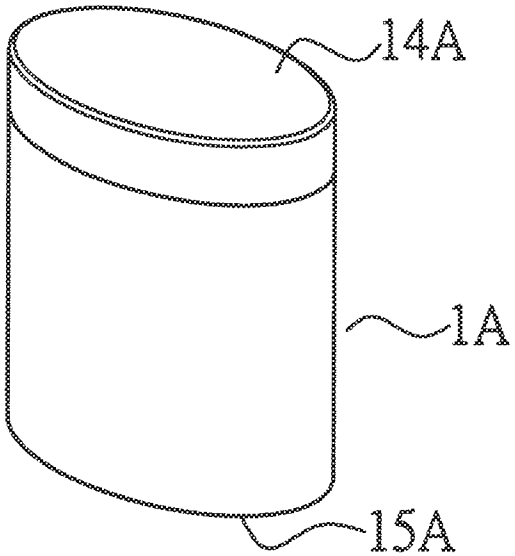
FIG. 8 is a perspective view of the wire connector of FIG. 7.

With reference to FIGS. 7-9, a wire connector of a second embodiment according to the present invention includes a connection box 1A having first and second ends spaced from each other in a longitudinal direction. The first end of the connection box 1A includes a first closed end wall 14A free of holes. In this embodiment, the first end wall 14A is in the form of a cover detachably mounted to the first end of the connection box 1A. The second end of the connection box 1A includes a second closed end wall 15A having a hole set 171. The hole set 171 includes at least one through-hole. In this embodiment, the hole set 171 includes three through-holes 171A, 171B, and 171C.

The connection box 1A further includes a compartment 38A having first and second end walls 40A and 42A spaced from each other in a height direction perpendicular to the longitudinal direction. At least one partitioning wall 19A extends from the second end wall 42A toward but spaced from the first end wall 40A, forming a gap 44A between each partitioning wall 19A and the first end wall 40A. The at least one partitioning wall 19A divides the compartment 38A into a plurality of channels 11A, 12A, 13A spaced from each other in a width direction perpendicular to the longitudinal and height directions. In this embodiment, the connection box 1A includes two partitioning walls 19A and three channels 11A 12A, and 13A. The channels 11A, 12A, and 13A are respectively aligned with and are in communication with the through-holes 171A, 171B, and 171C of the hole set 171. Each channel 11A, 12A, 13A has a first end at the first end wall 40A and a second end at the second end wall 42A. The first ends of the channels 11A, 12A, and 13A and the gaps 44A together define a receiving groove 18A. The receiving groove 18A is flat.

The wire connector of the second embodiment further includes an elastic pressing plate 21A received in each channel 11A, 12A, 13A. A conductive plate 3A is received in the receiving groove 18A and has a shape corresponding to a shape of the receiving groove 18A. The conductive plate 3A abuts each elastic pressing plate 21A. The wire connector of the second embodiment has a reduced height in the height direction by providing the flat receiving groove 18A and the flat conductive plate 3A, allowing the wire connector to be used in a small space.

At least one of the elastic pressing plates 21A is vortical. As an example, one of the elastic pressing plates 21A includes an inner section 221C and an outer section integral with the inner section 221C. The inner section 221C includes a bent arm 221B abutting against the outer section to provide a resistance to a force imparted to the outer section pressing against the bent arm 221B when an end of an electric wire 4 is inserted into a corresponding one of the channels 11A, 12A and 13A. The inner section 221C of the elastic pressing plate 21A elastically presses against the end of the electric wire 4 to firmly retain the end of the electric wire 4 in place, assuring reliable electrical conduction (see FIGS. 4A and 4B). In this example, the bent arm 221B is formed by bending a distal end of the inner section 221C of the elastic pressing plate 22.

In another example, one of the elastic pressing plates 21A is vortical and includes an outer section 212C and an inner section integral with the outer section 212C. The outer section 212C of the elastic pressing plate 21A has a hook 212B. The hook 212B includes a V-shaped groove for receiving a portion of the end of the electric wire 4. Thus, when the end of the electric wire 4 enters one of the channels 11A, 12A, and 13A, the hook 212B can provide a hooking effect to prevent disengagement of the electric wire 4 under a pulling force (see FIGS. 4A and 4B). To allow easy fabrication, the hook 212A is preferably formed at a distal end of the outer section 212C. The other elastic pressing plates 21A can also include a hook 212A.

Although specific embodiments have been illustrated and described, numerous modifications and variations are still possible without departing from the scope of the invention. The scope of the invention is limited by the accompanying claims.

The invention claimed is:

1. A wire connector comprising:

a connection box including first and second ends spaced from each other in a longitudinal direction, with the first end of the connection box including a first closed end wall having a first hole set, with the second end of the connection box including a second closed end wall having a second hole set, with each of the first and second hole sets including at least one through-hole, with the connection box further including a compartment having first and second end walls spaced from each other in a height direction perpendicular to the longitudinal direction, with at least one partitioning wall extending from the second end wall toward but spaced from the first end wall, defining a gap between the at least one partitioning wall and the first end wall, with the at least one partitioning wall dividing the compartment into a plurality of channels spaced from each other in a width direction perpendicular to the longitudinal and height directions, with the plurality of channels respectively aligned with and in communication with the at least one through-hole of the first hole set and the at least one through-hole of the second hole set, with each of the plurality of channels having a first end at the first end wall and a second end at the second end wall, with the first ends of the plurality of channels and the gap together defining a receiving groove, and with the receiving groove being flat;

an elastic pressing plate received in each of the plurality of channels; and a conductive plate received in the receiving groove and having a shape corresponding to a shape of the receiving groove, with the conductive plate abutting each elastic pressing plate.

2. The wire connector as claimed in claim 1, with at least one of the elastic pressing plates being vortical and including an inner section and an outer section, with the inner section including a bent arm, with the bent arm abutting against the outer section and adapted to provide a resistance to a force imparted to the outer section pressing against the bent arm.

3. The wire connector as claimed in claim 2, with the bent arm formed by bending a distal end of the inner section of the elastic pressing plate.

4. The wire connector as claimed in claim 2, with each elastic pressing plate being vortical, and with the outer section of each elastic pressing plate having a hook.

5. The wire connector as claimed in claim 4, with the hook formed at a distal end of the outer section.

6. A wire connector comprising:

a connection box including first and second ends spaced from each other in a longitudinal direction, with the first end of the connection box including a first closed end wall, with the second end of the connection box including a second closed end wall having a hole set, with the hole set including at least one through-hole, with the connection box further including a compartment having first and second end walls spaced from each other in a height direction perpendicular to the longitudinal direction, with at least one partitioning wall extending from the second end wall toward but spaced from the first end wall, defining a gap between the at least one partitioning wall and the first end wall, with the at least one partitioning wall dividing the compartment into a plurality of channels spaced from each other in a width direction perpendicular to the longitudinal and height directions, with the plurality of channels respectively aligned with and in communication with the at least one through-hole of the hole set, with each of the plurality of channels having a first end at the first end wall and a second end at the second end wall, with the first ends of the plurality of channels and the gap together defining a receiving groove, and with the receiving groove being flat;

an elastic pressing plate received in each of the plurality of channels; and a conductive plate received in the receiving groove and having a shape corresponding to a shape of the receiving groove, with the conductive plate abutting each elastic pressing plate.

7. The wire connector as claimed in claim 6, with at least one of the elastic pressing plates being vortical and including an inner section and an outer section, with the inner section including a bent arm, and with the bent arm abutting against the outer section and adapted to provide a resistance to a force imparted to the outer section pressing against the bent arm.

8. The wire connector as claimed in claim 7, with the bent arm formed by bending a distal end of the inner section of the elastic pressing plate.

9. The wire connector as claimed in claim 7, with each elastic pressing plate being vortical, and with the outer section of each elastic pressing plate having a hook.

10. The wire connector as claimed in claim 9, with the hook formed at a distal end of the outer section.

* * * * *